United States Patent [19]

Jamieson

[11] 4,428,695

[45] Jan. 31, 1984

[54] CARTRIDGE WITH SELF ADJUSTING PRESSURE ROLLER AND END OF RIBBON DETECTION MEANS

[75] Inventor: John W. Jamieson, Alamo, Calif.

[73] Assignee: Qume Corporation, San Jose, Calif.

[21] Appl. No.: 377,423

[22] Filed: May 12, 1982

[51] Int. Cl.[3] ..... B41J 35/36

[52] U.S. Cl. ..... 400/249; 400/208; 400/235.1; 400/234; 400/636; 400/641; 400/716

[58] Field of Search ..... 400/194, 195, 196, 196.1, 400/207, 208, 208.1, 235.1, 249, 636, 641, 661.2, 661.3, 662, 694, 708, 708.1, 716, 234

[56] References Cited

U.S. PATENT DOCUMENTS

| | | | |
|---|---|---|---|
| 1,098,840 | 6/1914 | Rennie | 400/641 |
| 3,409,113 | 11/1968 | McLean | 400/235.1 X |
| 4,011,933 | 3/1977 | Kern | 400/208 |
| 4,053,042 | 10/1977 | Hess | 400/235.1 X |
| 4,091,913 | 5/1978 | Ku et al. | 400/235.1 X |
| 4,115,013 | 9/1978 | Hedstrom | 400/208 X |
| 4,197,024 | 4/1980 | Huntoon | 400/641 X |
| 4,210,403 | 7/1980 | Mazouet et al. | 400/641 X |
| 4,231,667 | 11/1980 | Behrendt et al. | 400/208 |
| 4,241,911 | 12/1980 | Lee | 400/641 X |
| 4,269,520 | 5/1981 | Gabler | 400/196.1 X |
| 4,272,202 | 6/1981 | Schroeder et al. | 400/641 X |
| 4,307,969 | 12/1981 | Daughters | 400/208 |
| 4,343,556 | 8/1982 | Kobayashi | 400/235.1 X |

FOREIGN PATENT DOCUMENTS

| | | | |
|---|---|---|---|
| 2646336 | 4/1978 | Fed. Rep. of Germany | 400/249 |
| 56-129191 | 10/1981 | Japan | 400/249 |

OTHER PUBLICATIONS

IBM Technical Disclosure Bulletin, "Transmissive Document Sensor" Anderson et al., vol. 23, No. 4, Sep. 1979, pp. 1585–1586.

IBM Technical Disclosure Bulletin, "Optical Means for End-of-Ribbon Sensing", Bullock et al., vol. 23, No. 9, Feb. 1981, pp. 3955–3956.

*Primary Examiner*—Ernest T. Wright, Jr.

*Attorney, Agent, or Firm*—T. E. Kristofferson; A. D. Stolzy

[57] ABSTRACT

A cartridge which contains two spools. The supply spool has wound about it a printing ribbon and the take-up spool being used for wrapping the used ribbon. The cartridge has a ribbon exit at one location and a ribbon entry at a remote location to define a path for the ribbon to pass therealong. Two drive gears are engaged with each other and a pressure roller. The drive gears are located and their lower portions are configured to engage the respective drive shafts of various printers. When the first drive gear is driven by a printer, the second gear, which includes the drive wheel, rotates in the opposite direction of the drive shaft of the printer. When the second gear is driven, the integral drive wheel rotates in the same direction as the drive shaft of the printer. The pressure roller is provided with internal flexible spokes, or springs, and provides a self-adjusting bias against the drive wheel to drive the ribbon and provides an extremely efficient pinching action. An end of ribbon detection system which includes a reflector or the like positioned between a sensor and the ribbon to allow optimization of the light path is also provided.

1 Claim, 6 Drawing Figures

FIG. 1
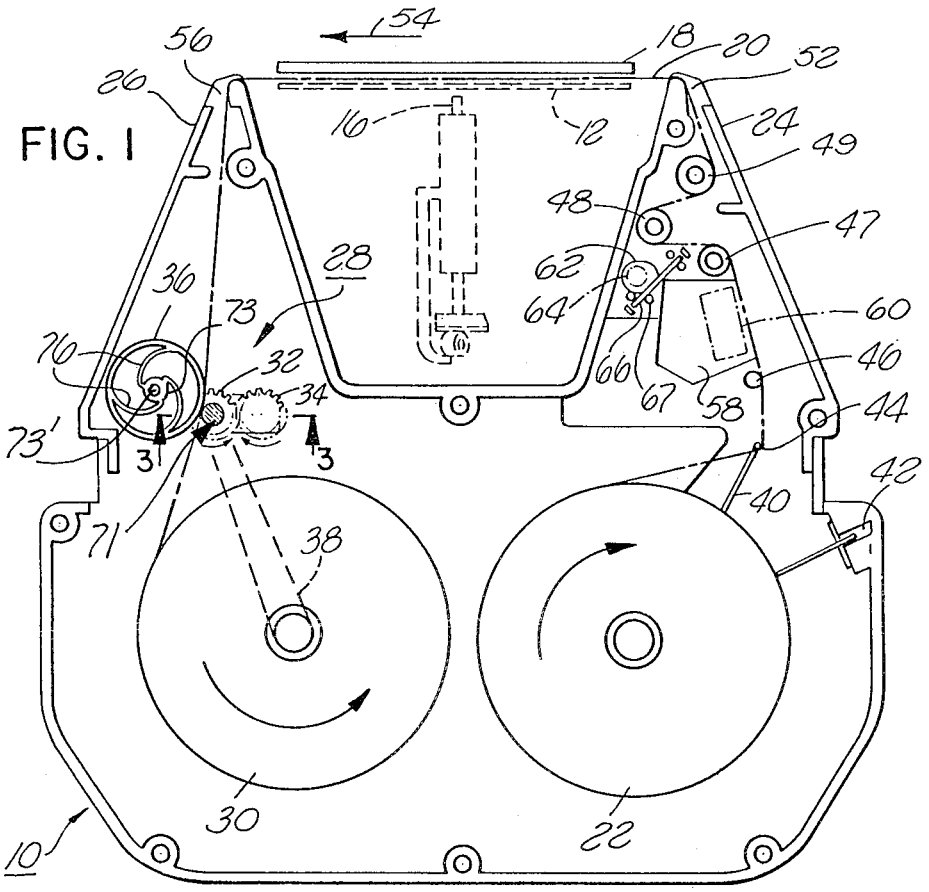
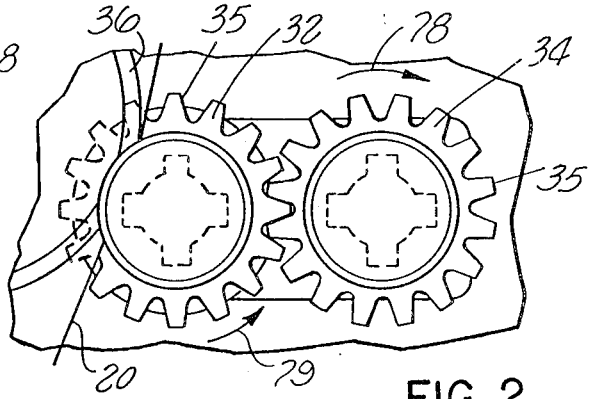
FIG. 2
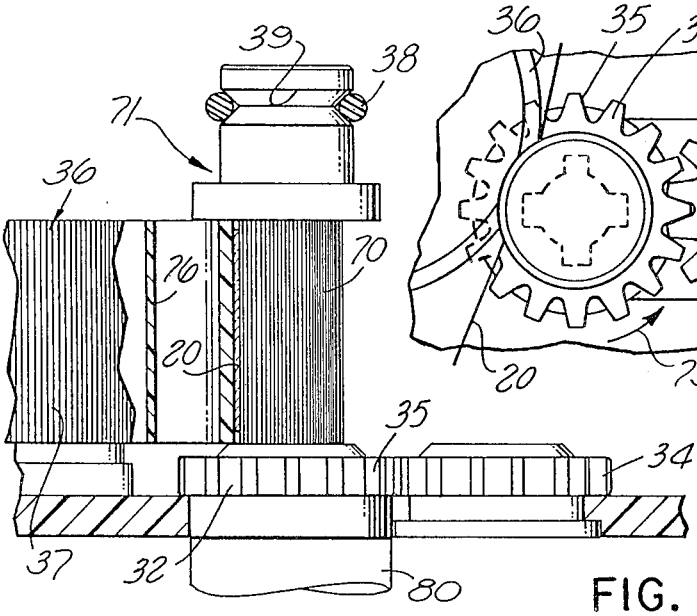
FIG. 3

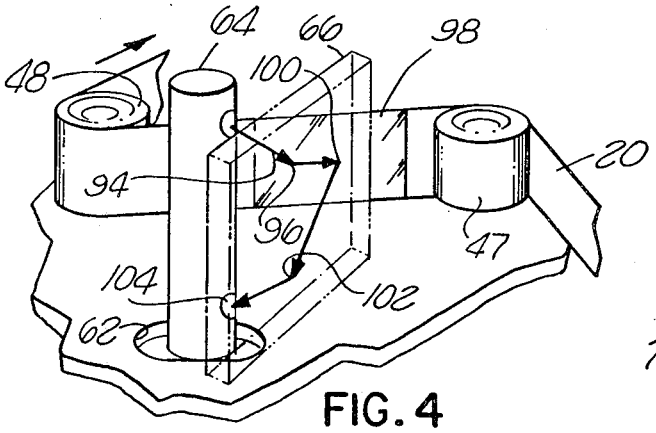
FIG. 4
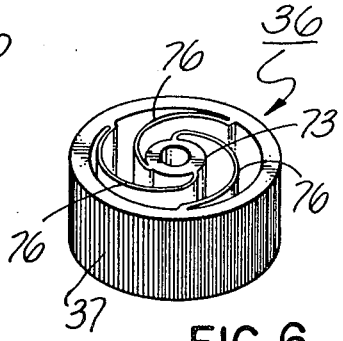
FIG. 6
FIG. 5
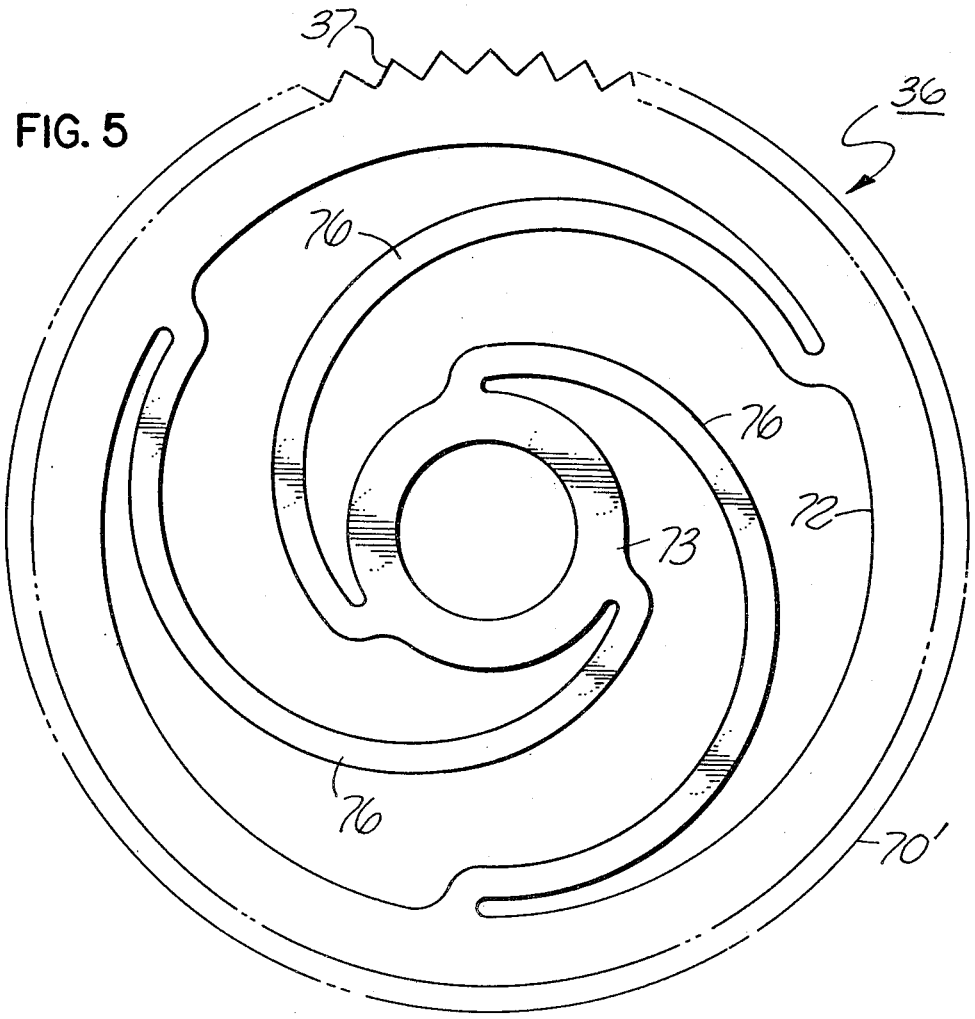

CARTRIDGE WITH SELF ADJUSTING PRESSURE ROLLER AND END OF RIBBON DETECTION MEANS

BACKGROUND OF THE INVENTION

Inked ribbon cartridges are known which supply an inked ribbon to a printing station of an associated printing device, e.g., a typewriter or a rotary printer of the daisy wheel type. In daisy wheel printers, a print wheel having a plurality of spokes extending from a central disk area is provided. The printer sequentially registers a wheel spoke, the spoke having characters formed on the end thereof, over a position on a sheet of paper. Once registered, a hammer strikes a spoke causing the spoke to move forward and into contact with the ribbon, leaving the desired character on the paper sheet. The aforementioned ribbon cartridges generally contain both a supply spool and a take-up spool.

A drive shaft from the printer engages the bottom portion of a drive wheel contained within the cartridge, the drive wheel typically having a serrated periphery. The ribbon passes between the drive wheel and a biased idler wheel and is thereby advanced along the path between the daisy wheel and the paper. The take-up spool is typically rotated by an external drive band, such band being driven by an extension of the drive wheel.

A number of daisy wheel type printers are currently available in the marketplace, including various models manufactured by Qume Corporation and Xerox Corporation. It has been determined that ribbon cartridges designed for use for a printer manufactured by one company will not necessarily fit a printer manufactured by another company. Further, it is also possible that different printers manufactured by the same company cannot use the same cartridges.

The invention set forth in U.S. Pat. No. 4,307,969 addressed this latter problem. As disclosed therein, Xerox Corporation manufactures at least two printers, the Diablo Hytype®I and Hytype®II, each one of which required different ribbon cartridges.

Since cartridges are an expendable supply item, they are consumed on a volume basis.

Even though printers and printer applications are similar, suppliers of such cartridges must provide different cartridges for different machines. Inventory problems can result because of the number of types of cartridges which must be supplied. Moreover, confusion as to the required supply of each type may also arise.

U.S. Pat. No. 4,307,969 discloses a cartridge having two drive gears serially engaged with each other and a third gear integral with the ribbon drive means. When the first gear is driven by the printer, the second acts as an idler gear so that the separate ribbon drive means rotates in the same direction as the drive shaft of the printer. When the second gear is driven, the ribbon drive means is driven directly so that the separate drive means rotates in the opposite direction as the drive shaft of the printer. The drive gears are located and their lower portions are configured to engage the respective drive shafts of various printers. The cartridge can accommodate drive shafts which rotate in opposite directions because of their gearing arrangements. Provision is made to gather the ribbon between an engaged ribbon drive wheel and an idler wheel to the take-up spool.

Although the ribbon cartridge disclosed in the aforementioned patent provides a "universal" cartridge, at least with respect to two Xerox printers, the cartridge contains a number of added components which increase manufacturing complexities, reduces reliability and adds to the manufacturing costs thereof. For example, a separate means for gathering the ribbon, which includes a gear and the means to drive the take-up spool and additional components to bias the idler wheel against the ribbon drive wheel are required.

Prior art "universal" cartridges typically include openings located at different positions to receive end-of-ribbon sensors associated with the particular printer being utilized. However, the positioning of the openings and the location of the ribbon as it is driven from the cartridge is such that at least one of the sensors becomes unreliable.

SUMMARY OF THE PRESENT INVENTION

The present invention provides a cartridge which contains a supply spool and a take-up spool. The supply spool has printing ribbon wound thereabout and the take-up spool wraps the used ribbon. The cartridge has a ribbon exit at one location and a ribbon entry at a second location to define a path for the ribbon to pass therealong. Two gears are engaged with each other and a pressure roller. The drive gears are located and their lower portions are configured to engage the drive shafts of various printers. When the first drive gear is driven by a printer, the second gear, which includes the drive wheel, rotates in the opposite direction of the drive shaft of the printer. When the second gear, which includes the drive wheel, is driven, it rotates in the same direction as the drive shaft of the printer. The pressure roller is provided with internal flexible spokes, or springs, and provides a self-adjusting bias against the drive wheel to drive the ribbon and provides an extremely efficient pinching action. An end of ribbon detection system which includes a reflector or the like positioned between a sensor and the ribbon to allow optimization of the light path is also provided.

It is an object of the present invention to provide a cartridge which can be adapted for use with two or more different printers.

It is a further object of the present invention to provide a cartridge which can be utilized with at least two different printers, the cartridge containing therein two drive gears and a pressure roller, a web being driven between the pressure roller and a drive wheel on one of said drive gears.

It is still a further object of the present invention to provide a universal cartridge which contains therein a ribbon interposed between a pressure roller and a drive means, the pressure roller having flexible spokes therein to provide a self-adjusting bias feature with an extremely efficient pinching action.

It is a further object of the present invention to provide a universal cartridge which contains therein a ribbon interposed between a pressure roller and a drive means, the pressure roller comprising flexible material inside a cylindrical shaped member to provide a self-adjusting bias feature with efficient pinching action along the length of the member.

It is still a further object of the present invention to provide a universal cartridge which contains therein a ribbon interposed between a pressure roller and a drive means and an end of ribbon detection system which includes a reflector or the like positioned between a sensor and the ribbon to allow optimization of the sensor light path.

BRIEF DESCRIPTION OF THE DRAWING

For a better understanding of the invention as well as other objects and further features thereof, reference is made to the following description which is to be read in conjunction with the drawing wherein:

FIG. 1 is a plan view of the ribbon cartridge of the present invention with the top half of the body removed with a daisy wheel printer schematically illustrated;

FIG. 2 is a view of the first and second driving gears mounted within an elongate hole in the bottom half of the body as seen from the inside of the cartridge;

FIG. 3 is a cross-sectional view along line 3—3 of FIG. 1;

FIG. 4 shows the novel end of ribbon detection configuration of the present invention;

FIG. 5 is a top plan view of the pressure roller of the present invention; and FIG. 6 is a perspective view of the pressure roller shown in FIG. 5.

DESCRIPTION OF THE PREFERRED EMBODIMENT

As will become self-evident in the discussion that follows, the principles of the present invention can be utilized to configure a cartridge for use in a multitude of applications, including audio, magnetic video or typewriter devices, as well as in printers (and with cartridges such as the cartridge disclosed in U.S. Pat. No. 4,053,042, which do not contain either a ribbon drive or take-up spool). Since the invention is presently adapted for use in daisy wheel printers, these types of printers will be described in general terms to enable the reader to better understand the invention.

Referring to FIG. 1, a ribbon cartridge 10, with the top cover removed, is shown with daisy wheel 12, hammer 16 and sheet 18. Daisy wheel 12 comprises a plurality of spokes extending from a central disk area, type of characters to be printed being formed on the outermost ends of the spokes. When a character is to be printed on sheet 18, daisy wheel 12 is rotated to the proper position and hammer 16 is activated and strikes the selected spoke. The selected spoke is driven forward against inked ribbon 20 thereby transferring ink to leave the character impression on sheet 18. The printer carriage assembly (not shown), wheel 12 and ribbon, or web, 20 is indexed for the next character printing, ribbon 20 being indexed to provide fresh ribbon for the next impression.

Cartridge 10 includes a supply spool 22 on which ribbon 20 is wound, a ribbon exit arm 24, a ribbon entry arm 26 and a means 28 to advance the ribbon 20 onto take-up spool 30. As set forth hereinabove, the teachings of the present invention related to the ribbon drive and end of ribbon detector can be applied to cartridges which do not incorporate supply and/or take-up spools. Further, the teachings of the present invention can be utilized with cartridge configurations not having separate exit and entry arms. Advance means 28 includes first and second drive gears 32 and 34, each having a toothed or serrated surface 35, flexible pressure roller 36 having a toothed or serrated surface 37 and drive wheel 71 (shown in more detail in FIG. 3). An external drive band 38 is also provided to assist advance means 28. A spring 40, one end of which is held in place by inserting it into an aperture 42 molded into the wall of the cartridge 10, provides a drag on supply spool 22 such that a proper tension is maintained on ribbon 20. Ribbon 20 winds its way past a first point 44 on spring 40 and rollers, or posts, 46, 47, 48 and 49, and then through an exit opening 52 at the end of exit arm 24. Ribbon 20 passes along a path in the direction of arrow 54 and re-enters cartridge 10 through an entrance opening 56 formed at the end of entrance area 26. A multisided opening 58 (a rectangular sensor 60 being shown in phantom within opening 58) and a circularly shaped opening 62 (a cylindrical sensor 64 being shown in phantom within opening 62) are formed in the bottom of cartridge 10. In accordance with one of the teachings of the present invention and as described in more detail with reference to FIG. 4, a mirror, or reflector, 66 is positioned via location posts 67 in the cartridge 10 between sensor 64 and ribbon 20.

Ribbon 20 is driven along its path by passing between the toothed, or serrated, surface 70 formed on an elongated extension, or drive wheel, 71 of drive gear 32 and the serrated surface 37 of pressure roller 36. Also mounted on the common shaft with drive gear 32 and extending outwardly past the top half (not shown) of cartridge 10 is an extension defining a groove 39 in which drive band 38 is seated. Band 38 also seats within a like extension extending from take-up spool 30. Rotation of drive gear 32 (either directly or due to the rotation of drive gear 34) results in the rotation of take-up spool 30.

Pressure roller 36 (shown in more detail in FIGS. 5 and 6) in the preferred embodiment is an annular cylindrical member having an outer surface 70 and inner surface 72 and having a plurality of flexible spokes 76, three shown, integrally molded to the inner surface 72 and extending to an inner concentric, hollow cylindrical member 73. Pressure roller 36 is rotatably mounted on cartridge 10 by mounting it, via member 73, onto a post member 73 integrally formed on the bottom of cartridge 10. Pressure roller 36, including flexible spokes 76, is preferably molded of a plastic material. The ratio of the length, or height, of each spoke 76, in the present embodiment, to the length of the pressure roller 36 is approximately 1/5 (the length of the spokes 76 may extend to substantially the whole length of pressure roller 36) and are located centrally within pressure roller 36. In essence, the flexible nature of the spokes 76 allows the pressure roller 36 to provide the pinch force to ribbon 20 and be self-leveling, i.e., a substantially uniform pinch force is applied along the length of member 70, the same uniform force being applied to the ribbon 20 driven between pressure roller 36 and drive wheel 71 and thus ensuring efficient and effective ribbon feed. Alternate configurations for the pressure roller 36 can be utilized.

As seen best at FIG. 2, drive gears 32 and 34 are mounted on the bottom half of cartridge 10, with gear 32 engaging both gear 34 and pressure roller 36. Gears 32 and 34 are located to overlay respective ribbon drive shafts from differing types of printers. Gears 32 and 34 have complementarily-shaped recesses for positive rotational engagement with their respective ribbon drive shafts as shown in U.S. Pat. No. 4,307,969. In different model printers, the drive shaft is located in a different position and this accounts for the use of two drive gears 32 and 34. The serial alignment of gears 32 and 34 allows the universal ribbon cartridge 10 to be used on printers with printer drives which rotate in opposite directions. This advantage exists because when drive gear 34 is driven by the driving head of the printer drive shaft in the direction of arrow 78, drive gear 32 acts as a direction reverser so that it and pressure roller 36 turn in the proper direction. When the driving head of the printer drive shaft engages and drives the drive gear 32 in the direction of arrow 79, both it and pressure roller 36 rotate in the proper direction.

Referring now to both FIGS. 2 and 3, drive gears 32 and 34 are mounted on the bottom half of cartridge 10 as shown. Gears 32 and 34 are relatively thin, cylindrical elements having teeth 35 around their circumferences. Although in the embodiment illustrated gears 32 and 34 have equal number of teeth, differing numbers of teeth may be utilized to compensate for differing drive rates of various printers. Gear 32 has an elongated, cylindrical extension, or drive wheel, 71 thereon which is coextensive with the length of pressure roller 36. The teeth on the surface 70 of extension 71 are adapted to engage the teeth 37 formed on the surface 70' of pressure roller 36, thus acting to drive the ribbon 20 passing therebetween. The center of pressure roller 36 is spaced from the center of drive wheel 71 such that pressure roller 36 is in a constant state of deformity whereby substantially constant pressure is applied to ribbon 20. FIG. 3 illustrates the printer drive shaft 80 engaging gear 32.

Many daisy wheel printers currently available, such as the Qume Sprint ®9, manufactured by Qume Corporation, San Jose, Calif., and the Diablo Hytype ®II, manufactured by Xerox Corporation, Hayward, Calif., have an end of ribbon (EOR) detect feature incorporated therein.

The EOR detect feature signals when the cartridge 10 is out of ribbon 20.

Cartridge 10 is designed to have both holes 58 and 62 in order to accommodate various printers each having different EOR sensor configurations located in different positions. For example, hole 58 is located to accommodate a rectangular sensor 60 utilized in the Diablo II printer. On the other hand, hole 62 is provided to accommodate the cylindrical sensor 64 utilized in the various Xerox printers.

In accordance with a further teaching of the present invention, the reflective member 66, such as a mirror, is mounted within the cartridge 10 as shown. If a cylindrical sensor 64 is utilized in the printer, mirror 66 is positioned between the cylindrical sensor 64 and ribbon 20 such that the light beam emitted from the sensor 64 is deflected to the ribbon 20 and if reflective tape 98 is present, it is reflected back to the mirror 66 and then to the sensor 64. Mirror 66 allows for optimization of the light path which normally is unattainable because of the physical placement of the sensor 64. It should be noted that mirror 66 may be flat or curved, a curved mirror being preferred since it is self-correcting and thus provides more tolerance for variances and thus improved reliability of the cylindrical sensor 64.

As shown in FIG. 4, a light beam 94 from sensor 64 is emitted parallel to ribbon 20 in the direction towards the bottom of the cartridge 10 and first hits mirror 66 at light beam path 96 (mirror 66 shown in phantom). The light beam 94 is reflected by mirror 66 at an angle of approximately 90° and intercepts a reflective tape portion 98 of ribbon 20 at point 100. The light beam 94 is reflected from tape 98 and hits mirror 66 a second time at point 102. Mirror 66, in turn, reflects beam 94 back to the sensor 64 at slot 104 parallel to ribbon 20 and in the direction towards the bottom of the cartridge 10. In accordance with the teaching of the present invention, mirror 64 allows ribbon 20 to be positioned to optimize the amount of light reflected/sensed and yet not to physically interfere with the rectangular sensor 60. Prior art designs for EOR detection in universal ribbon cartridges have failed to adequately compensate for sensing by the cylindrical sensor 64 when setting aside an area defined by hole 58 since ribbon 20 could not follow a path which interfered with hole 58.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A ribbon cartridge for use in printing devices of the type having mounted thereon either a first light source for emitting a first light beam and an associated first light sensor for detecting an end of ribbon condition, or a second light source for emitting a second light beam and an associated second light sensor for detecting an end of ribbon condition, said ribbon cartridge comprising:

a housing;

an inked ribbon having a reflective end surface;

transport means including first and second spools within said housing for transporting said ribbon in a vertical orientation;

first and second openings in the bottom of said housing and positioned so that said first or said second light source and said first or said second sensor may extend through one of said openings into said housing as the ribbon cartridge is mounted in a printing device; and, a mirror positioned within said housing in a position to intercept said first light beam from said first light source extending into said housing through one of said openings and reflect said first light beam onto said ribbon, said reflected light beam being again reflected from the reflective end surface of said ribbon to said mirror and then to said first light sensor;

said transport means including means for transporting said inked ribbon along a path which intercepts either said second light beam emitted by said second light source extending into said housing through a first of said openings and reflects said second light beam to said second sensor or intercepts said first light beam emitted by said first light source extending into said housing through a second of said openings after said first light beam has been reflected by said mirror and reflects said first light beam back to said mirror;

whereby said ribbon cartridge may be utilized in printing devices having light sources and sensors mounted at either one of two positions thereon.

* * * * *